US007147998B2

(12) United States Patent
Hammerschmidt et al.

(10) Patent No.: US 7,147,998 B2
(45) Date of Patent: Dec. 12, 2006

(54) THERMALLY DEVELOPABLE MATERIALS CONTAINING ANIONIC POLYMER OVERCOAT

(75) Inventors: Jon A. Hammerschmidt, Rochester, NY (US); Jeffrey W. Leon, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 193 days.

(21) Appl. No.: 10/935,635

(22) Filed: Sep. 7, 2004

(65) Prior Publication Data

US 2006/0052245 A1 Mar. 9, 2006

(51) Int. Cl.
*G03C 1/498* (2006.01)
*G03C 1/89* (2006.01)

(52) U.S. Cl. ..... 430/529; 430/531; 430/617; 430/618; 430/619; 430/620

(58) Field of Classification Search ..... 430/528, 430/531, 617, 618, 619, 620
See application file for complete search history.

(56) References Cited

U.S. PATENT DOCUMENTS

| | | | | |
|---|---|---|---|---|
| 4,741,992 | A | 5/1988 | Przezdziecki | |
| 5,370,982 | A * | 12/1994 | Tashiro et al. | 430/529 |
| 5,770,353 | A * | 6/1998 | Wang et al. | 430/501 |
| 5,989,796 | A | 11/1999 | Moon | |
| 6,132,950 | A | 10/2000 | Ishigaki et al. | |
| 6,140,038 | A | 10/2000 | Ishizuka et al. | |
| 6,261,754 | B1 | 7/2001 | Ishigaki et al. | |
| 6,303,281 | B1 * | 10/2001 | Wang et al. | 430/523 |
| 6,312,885 | B1 | 11/2001 | Fujita et al. | |
| 6,344,313 | B1 | 2/2002 | Goto et al. | |
| 6,423,487 | B1 | 7/2002 | Naoi | |
| 6,475,710 | B1 | 11/2002 | Kudo et al. | |
| 2001/0044069 | A1 | 11/2001 | Ito | |

FOREIGN PATENT DOCUMENTS

| | | |
|---|---|---|
| EP | 1041434 | 10/2000 |
| EP | 1079271 | 2/2001 |
| EP | 0 902322 | 11/2003 |

OTHER PUBLICATIONS

JP Abstract 2000-181004.
JP Abstract 2001-92074.
JP Abstract 2001-194744.
JP Abstract 2001-235835.
JP Abstract 2001-272750.
JP Abstract 2001-281791.
JP Abstract 2002-62610.
U.S. Appl. No. 10/935,644, filed herewith, titled "Thermally Developable Materials Containing Cationic Overcoat Polymer" by Hammerschmidt et al.
U.S. Appl. No. 10/935,641, filed herewith, titled "Thermally Developable Materials Containing Ionic Polymer Interlayer" by Hammerschmidt et al.

* cited by examiner

*Primary Examiner*—Hoa Van Le
(74) *Attorney, Agent, or Firm*—J. Lanny Tucker; Louis M. Leichter

(57) ABSTRACT

Thermally developable imaging materials have an outermost protective layer that is composed of one or more hydrophilic film-forming components. The predominant film-forming component is a negatively-charged latex polymer that has negatively-charged ionic groups other than carboxy groups. The latex polymer is present as latex particles that have been prepared in the presence of a nonionic stabilizer in an amount of at least 0.5% (by weight) that has an HLB value of 7 to 20. The nonionic stabilizer becomes associated with the latex polymer particles. Both thermographic and photothermographic materials can be prepared with such protective layers.

34 Claims, No Drawings

THERMALLY DEVELOPABLE MATERIALS CONTAINING ANIONIC POLYMER OVERCOAT

FIELD OF THE INVENTION

This invention relates to aqueous-based thermally developable imaging materials (both thermographic and photothermographic materials) having outermost protective layers composed of certain anionic polymeric formulations. It also relates to methods of imaging and using these materials.

BACKGROUND OF THE INVENTION

Silver-containing photothermographic imaging materials (that is, thermally developable photosensitive imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photo-sensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

Thermographic and photothermographic materials generally include a protective outer layer to protect the imaging layer and eventual image from damage from imaging equipment, spills, debris, and fingerprints.

Various overcoats or barrier layers have been developed to address these problems. For example, it is known from U.S. Pat. No. 5,422,234 (Bauer et al.) and U.S. Pat. No. 5,989,796 (Moon) to use a hydrophilic surface overcoat layer in photothermographic materials. Various barrier layer polymers are described in U.S. Pat. No. 6,352,819 (Kenney et al.), U.S. Pat. No. 6,250,561 (Miller et al.), U.S. Pat. No. 6,352,820 (Bauer et al.), and U.S. Pat. No. 6,420,102 (Bauer et al.).

Cellulose acetate polymers and their ester derivatives have been widely described as useful in overcoats of photothermographic materials. Other overcoat formulations are described in U.S. Pat. No. 5,536,696 (Uyttendaele et al.), U.S. Pat. No. 4,741,992 (Przezdziecki et al.), U.S. Pat. No. 5,759,752 (Uyttendaele et al.), and U.S. Pat. No. 6,344,313 (Goto et al.).

Many conventional thermally developable materials have layers formulated in various organic solvents, but there is interest for providing imaging layers that are coated out of aqueous solvents to minimize the environmental impact of organic solvents. However, it is difficult to provide protective outer layers for such aqueous imaging layers that are sufficiently resistant to water and damage from handling and imaging equipment. Moreover, it has been difficult to formulate protective layers that will inhibit the diffusion of imaging components from aqueous-based imaging layers containing gelatin and other hydrophilic binders. The result of this chemical migration is reduced image density and photographic speed.

There remains a need for thermally developable materials comprising aqueous-based imaging layers that are protected by water-resistant and durable outermost protective layers that reduce or eliminate the diffusion of imaging components.

SUMMARY OF THE INVENTION

This invention provides a thermally developable imaging material comprising a support and having thereon one or more thermally developable imaging layers and an outermost protective layer over the one or more thermally developable imaging layers, the one or more thermally developable imaging layers comprising a hydrophilic binder or water-dispersible latex polymer and in reactive association:

a) a source of reducible silver ions comprising an organic silver salt, and b) an ascorbic acid or reductone reducing agent for the reducible silver ions, and the outermost protective layer having a surface pH less than 6 and comprising a negatively-charged latex polymer other than a carboxy-containing latex polymer, the negatively-charged latex polymer comprising at least 50% by dry weight of total protective layer film-forming components and from about 0.4 to about 20 mol % of recurring units derived from ethylenically unsaturated polymerizable monomers comprising sulfate, sulfonates, phosphate or phosphonate groups, or their conjugate acids.

In specific embodiments, this invention provides a black-and-white photothermographic material comprising a support and having thereon one or more photothermographic layers and an outermost protective layer over the one or more photothermographic layers, the one or more photothermographic layers comprising a hydrophilic binder or water-dispersible latex polymer and in reactive association:

a) a source of reducible silver ions comprising a silver salt of an N-heterocyclic compound, b) an ascorbic acid or reductone reducing agent for the reducible silver ions, c) a photosensitive silver halide, and d) a mercaptotriazole toner, the outermost protective layer having a surface pH less than 6 and comprising negatively-charged latex polymer other than a carboxy-containing latex polymer, the negatively-charged latex polymer comprising at least 50% by dry weight of total protective layer film-forming components and from about 0.4 to about 20 mol % of recurring units derived from charged ethylenically unsaturated polymerizable monomers comprising sulfate, sulfonates, phosphate or phosphonate groups, or their conjugate acids, and said negatively-charged latex polymer having been prepared in the presence of a non-ionic stabilizer that becomes associated therewith, the stabilizer having an HLB value of from about 7 to about 20 and being present during latex polymer preparation in an amount of from about 0.5 to about 10% based on the dry weight of the negatively-charged latex polymer.

Preferred embodiments of this invention comprise a black-and-white photothermographic material comprising a support and having thereon one or more imaging layers and an outermost protective layer over the one or more imaging layers, the one or more imaging layers comprising predominantly gelatin or a derivative thereof, a poly(vinyl alcohol), or a water-dispersible latex polymer, and in reactive association:

a) a source of reducible silver ions comprising silver benzotriazole, b) an ascorbic acid reducing agent for the reducible silver ions, and c) photosensitive silver bromide or silver iodobromide that is present as tabular grains, and the outermost protective layer having a surface pH of from about 4.2 to about 4.6 and comprising a negatively-charged latex polymer other than a carboxy-containing latex polymer, the negatively-charged latex polymer comprising from about 80 to about 95% by dry weight of the total protective layer film-forming components, and from about 0.4 to about 10 mol % of recurring units derived from ethylenically unsaturated polymerizable monomers comprising sulfonates or their conjugate acids, and a second film-forming component that is gelatin or a gelatin derivative.

Double-sided embodiments of the present invention include a black-and-white photothermographic material comprising a support having on a frontside thereof, a) one or more frontside thermally developable imaging layers comprising a hydrophilic polymer or a water-dispersible latex polymer as the binder, and in reactive association, a photosensitive silver halide, a non-photosensitive source of reducible silver ions that includes a silver salt of a compound containing an imino group, an ascorbic acid or reductone reducing agent for the non-photosensitive source reducible silver ions, and the material comprising on the backside of the support, one or more backside thermally developable imaging layers comprising a hydrophilic polymer or a water-dispersible latex polymer as the binder, and in reactive association, a photosensitive silver halide, a non-photosensitive source of reducible silver ions that includes a silver salt of a compound containing an imino group, and an ascorbic acid or reductone reducing agent for the non-photosensitive source reducible silver ions, and wherein the one or more thermally developable imaging layers on both sides of the support have the same or different composition, and b) an outermost protective layer over the one or more thermally developable imaging layers on both sides of the support, each protective layer having the same or different composition, and each protective layer having a surface pH less than 6 and comprising a negatively-charged latex polymer other than a carboxy-containing latex polymer, the negatively-charged latex polymer comprising at least 50% by dry weight of total protective layer film-forming components, and from about 0.4 to about 20 mol % of recurring units derived from ethylenically unsaturated polymerizable monomers comprising sulfate, sulfonates, phosphate, or phosphonate groups, or their conjugate acids.

This invention also provides a method of forming a visible image comprising:

A) imagewise exposing the photothermographic material of the invention to form a latent image, B) simultaneously or sequentially, heating the exposed photothermographic material to develop the latent image into a visible image.

In most embodiments of the method of this invention, imagewise exposure is carried out using visible light or X-radiation, and the photothermographic material can be arranged in association with one or more phosphor intensifying screens during imaging in what is known in the art as an imaging assembly. The resulting visible image can be used for medical diagnosis.

The particular outermost protective layers used in the present invention have a surface pH less than 6 and are formulated using a negatively-charged latex primary other than a carboxy-containing latex polymer. The negatively-charged latex polymer includes a certain amount of recurring units derived from negatively-charged ethylenically unsaturated polymerizable monomers comprising sulfate, sulfonates, phosphate or phosphonate groups, or their conjugate acids. We have found that this particular film-forming polymer in the outermost protective layer provides increased photographic speed and density. Thus, the use of outermost protective layers composed of negatively-charged latex polymers results in greater speed and density compared with the use of outermost protective layers composed primarily of hydrophilic binders such as gelatin. The outermost protective layer must also be formulated at a pH below 6 in order to be compatible with the imaging layer, and the negatively-charged latex polymer used in this layer is stable at a pH range from 3.5 to 7.

These latex polymers are preferably prepared using a nonionic stabilizer that becomes associated with the surface of the latex polymer particles. The resulting polymer latex may be used after various purification techniques (described below) that may remove most of the nonionic stabilizer but the remainder of the stabilizer remains associated with the latex polymer particles. Alternatively, the polymer latex can be used without such purification techniques and the original amount of nonionic stabilizer remains associated with the dried latex polymer particles.

DETAILED DESCRIPTION OF THE INVENTION

The thermally developable materials can be used in black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

While both thermographic and photothermographic materials are contemplated within the invention, the following details will be focused primarily on the photothermographic materials. However, a skilled artisan would know how to adapt this teaching to prepare and use thermographic materials as well.

The photothermographic materials are particularly useful for medical imaging of human or animal subjects in response to visible or X-radiation for use in medical diagnosis. Such applications include, but are not limited to, thoracic imaging, mammography, dental imaging, orthopedic imaging, general medical radiography, therapeutic radiography, veterinary radiography, and auto-radiography. Increased sensitivity to X-radiation can be imparted through the use of phosphors. When used with X-radiation, the photothermographic materials may be used in combination with one or more phosphor intensifying screens, with phosphors incorporated within the photothermographic emulsion, or with a combination thereof.

The photothermographic materials can be made sensitive to radiation of any suitable wavelength. Thus, in some embodiments, the materials are sensitive at ultraviolet, visible, near infrared, or infrared wavelengths of the electromagnetic spectrum. In these embodiments, the materials are preferably sensitive to radiation greater than 300 nm (such as sensitivity to, from about 300 nm to about 450 nm and preferably from about 360 to about 450 nm). Increased sensitivity to a particular region of the spectrum is imparted through the use of various sensitizing dyes.

The photothermographic materials are also useful for non-medical uses of visible or X-radiation (such as X-ray lithography and industrial radiography).

In some embodiments of the thermally developable materials, the components needed for imaging can be in one or more imaging or emulsion layers on one side ("frontside") of the support. The layer(s) that contain the photo-sensitive photocatalyst (such as a photosensitive silver halide) for photothermographic materials or the non-photosensitive source of reducible silver ions, or both, are referred to herein as the emulsion layer(s). In photothermographic materials, the photocatalyst and non-photosensitive source of reducible silver ions are in catalytic proximity and preferably are in the same emulsion layer. Various non-imaging layers can also be disposed on the "backside" (non-emulsion or non-imaging side) of the materials, including, conductive layers, antihalation layer(s), protective layers, antistatic layers, and transport enabling layers.

Various non-imaging layers can also be disposed on the "frontside" or imaging or emulsion side of the support, including primer layers, interlayers, opacifying layers, antistatic layers, antihalation layers, acutance layers, auxiliary layers, and other layers readily apparent to one skilled in the art.

For preferred embodiments, it is desired that the thermally developable materials are "double-sided" or "duplitized" and have the same or different emulsion coatings (or imaging layers) on both sides of the support. In such constructions each side can also include one or more primer layers, interlayers, antistatic layers, acutance layers, antihalation layers, auxiliary layers, conductive layers, anti-crossover layers, and other layers readily apparent to one skilled in the art. Preferably, the imaging layers and protective layers are the same on both sides of the support.

When the photothermographic materials are heat-developed as described below in a substantially water-free condition after, or simultaneously with, imagewise exposure, a black-and-white silver image is obtained.

DEFINITIONS

As used herein:

In the descriptions of the thermally developable imaging materials, "a" or "an" component refers to "at least one" of that component (for example, the negatively-charged latex polymers).

Unless otherwise indicated, when the terms "thermally developable imaging materials", "thermographic materials", or "photothermographic materials" are used herein, it is in reference to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of emulsion layers wherein the photosensitive silver halide and the source of reducible silver ions are in one layer and the other essential components or desirable additives are distributed, as desired, in the same layer or in an adjacent coated layer. These materials also include multilayer constructions in which one or more imaging components are in different layers, but are in "reactive association." For example, one layer can include the non-photosensitive source of reducible silver ions and another layer can include the reducing agent and/or photosensitive silver halide.

When used in photothermography, the term, "imagewise exposing" or "imagewise exposure" means that the material is imaged using any exposure means that provides a latent image using electromagnetic radiation. This includes, for example, analog exposure where an image is formed by projection onto the photosensitive material as well as digital exposure where the image is formed one pixel at a time such as by modulation of scanning laser radiation.

"Thermographic material(s)" can be similarly constructed but are intentionally non-photosensitive (thus no photosensitive silver halide is intentionally added or generated).

When used in thermography, the term "imagewise exposing" or "imagewise exposure" means that the material is imaged using any suitable thermal imaging source such as a thermal print head.

"Catalytic proximity" or "reactive association" means that the materials are in the same layer or in adjacent layers so that they readily come into contact with each other during thermal imaging and development.

"Emulsion layer," "imaging layer," or "photothermographic (or "thermographic") emulsion layer," means a layer of a photothermographic (or thermographic) material that contains the photosensitive silver halide (not present in thermographic materials) and/or non-photosensitive source of reducible silver ions. It can also mean a layer of the material that contains, in addition to the photosensitive silver halide and/or non-photosensitive source of reducible ions, additional imaging components and/or desirable additives such as the reducing agent(s). These layers are usually on what is known as the "frontside" of the support but they can be on both sides of the support.

In addition, "frontside" also generally means the side of a thermally developable material that is first exposed to imaging radiation, and "backside" generally refers to the opposite side of the thermally developable material.

"Photocatalyst" means a photosensitive compound such as silver halide that, upon exposure to radiation, provides a compound that is capable of acting as a catalyst for the subsequent development of the thermally developable material.

Many of the chemical components used herein are provided as a solution. The term "active ingredient" means the amount or the percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 nm to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

The sensitometric term "absorbance" is another term for optical density (OD).

The sensitometric terms "photospeed," "speed," or "photographic speed" (also known as sensitivity), absorbance, contrast, Dmin, and Dmax have conventional definitions known in the imaging arts. In photothermographic materials, Dmin is considered herein as image density achieved when the photothermographic material is thermally developed without prior exposure to radiation. Dmax is the maximum density of film in the imaged area.

As used herein, the phrase "organic silver coordinating ligand" refers to an organic molecule capable of forming a bond with a silver atom. Although the compounds so formed are technically silver coordination compounds they are also often referred to as silver salts.

In the compounds described herein, no particular double bond geometry (for example, cis or trans) is intended by the structures drawn unless otherwise specified. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), hydroxyalkyl (such as 1,2-dihydroxyethyl), haloalkyl, nitroalkyl, alkylcarboxy, carboxyalkyl, carboxamido, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

The photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred silver halides, with the latter silver halide having up to 10 mol % silver iodide based on total silver halide.

In some embodiments, higher amounts of iodide may be present in the photosensitive silver halide grains up to the saturation limit of iodide as described in U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred. More preferably, the silver halide grains are predominantly (at least 50% based on total silver halide) present as tabular grains.

The silver halide grains may have a uniform ratio of halide throughout. They may have a graded halide content, with a continuously varying ratio of, for example, silver bromide and silver iodide, or they may be of the core-shell type, having a discrete core of one or more silver halides, and a discrete shell of one of more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetraazaindene or an N-heterocyclic compound comprising at least one mercapto group as described in U.S. Pat. No. 6,413,710 (Shor et al.), that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process, and then be added to and physically mixed with the non-photosensitive source of reducible silver-ions.

It is also possible to form the source of reducible silver ions in the presence of ex-situ-prepared silver halide. In this process, the source of reducible silver ions, such as a silver salt of an imino compound, is formed in the presence of the preformed silver halide grains. Co-precipitation of the reducible source of silver ions in the presence of silver halide provides a more intimate mixture of the two materials [see, for example U.S. Pat. No. 3,839,049 (Simons)] to provide a "preformed emulsion."

It is also effective to use an in-situ process in which a halide- or halogen-containing compound is added to an organic silver salt to partially convert the silver of the organic silver salt to silver halide. Inorganic halides (such as zinc bromide, calcium bromide, lithium bromide, or zinc iodide) or an organic halogen-containing compound (such as N-bromosuccinimide or pyridinium hydrobromide perbromide) can be used. The details of such in-situ generation of silver halide are well known and described for example in U.S. Pat. No. 3,457,075 (Morgan et al.).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and Japanese Kokai 49-013224, (Fuji), 50-017216 (Fuji), and 51-042529 (Fuji).

In general, the non-tabular silver halide grains used in this invention can vary in average diameter of up to several micrometers (μm) and they usually have an average particle size of from about 0.01 to about 1.5 μM (preferably from about 0.03 to about 1.0 μm, and more preferably from about 0.05 to about 0.8 μm).

The average size of the photosensitive silver halide grains is expressed by the average diameter if the grains are spherical, and by the average of the diameters of equivalent circles for the projected images if the grains are cubic, tabular, or other non-spherical shapes. Representative grain sizing methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

In most preferred embodiments of this invention, the silver halide grains are provided predominantly (based on at least 50 mol % silver) as tabular silver halide grains that are considered "ultrathin" and have an average thickness of at least 0.02 μm and up to and including 0.10 μm (preferably, an average thickness of at least 0.03 μm and more preferably of at least 0.04 μm, and up to and including 0.08 μm and more preferably up to and including 0.07 μm).

In addition, these ultrathin tabular grains have an equivalent circular diameter (ECD) of at least 0.5 μm (preferably at least 0.75 μm, and more preferably at least 1 μm). The ECD can be up to and including 8 μm (preferably up to and including 6 μm, and more preferably up to and including 4 μm).

The aspect ratio of the useful tabular grains is at least 5:1 (preferably at least 10:1, and more preferably at least 15:1) and generally up to 50:1. The grain size of ultrathin tabular grains may be determined by any of the methods commonly employed in the art for particle size measurement, such as those described above.

The ultrathin tabular silver halide grains can also be doped using one or more of the conventional metal dopants known for this purpose including those described in *Research Disclosure* item 38957, September, 1996 and U.S. Pat. No. 5,503,970 (Olm et al.), incorporated herein by reference. Preferred dopants include iridium (III or IV) and ruthenium (II or III) salts.

Mixtures of both in-situ and ex-situ silver halide grains may be used.

The one or more light-sensitive silver halides used in the photothermographic materials are preferably present in an amount of from about 0.005 to about 0.5 mole (more preferably from about 0.01 to about 0.25 mole, and most preferably from about 0.03 to about 0.15 mole) per mole of non-photosensitive source of reducible silver ions.

Chemical Sensitizers

The photosensitive silver halides used in photothermographic materials can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures and compounds are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), and U.S. Pat. No. 5,691,127 (Daubendiek et al.), and EP 0 915 371 A1 (Lok et al.), all incorporated herein by reference.

Certain substituted or and unsubstituted thioureas can be used as chemical sensitizers including those described in U.S. Pat. No. 6,296,998 (Eikenberry et al.), U.S. Pat. No. 6,322,961 (Lam et al.), U.S. Pat. No. 4,810,626 (Burgmaier et al.), and U.S. Pat. No. 6,368,779 (Lynch et al.), all of the which are incorporated herein by reference.

Still other useful chemical sensitizers include tellurium- and selenium-containing compounds that are described in U.S. Pat. No. 6,699,647 (Lynch et al.), U.S. Pat. No. 5,158,892 (Sasaki et al.), U.S. Pat. No. 5,238,807 (Sasaki et al.), U.S. Pat. No. 5,942,384 (Arai et al.), and U.S. Pat. No. 6,620,577 (Lynch et al.), all of which are incorporated herein by reference.

Noble metal sensitizers for use in the present invention include gold, platinum, palladium and iridium. Gold (+1 or +3) sensitization is particularly preferred, and described in U.S. Pat. No. 5,858,637 (Eshelman et al.) and U.S. Pat. No. 5,759,761 (Lushington et al.). Combinations of gold(III) compounds and either sulfur- or tellurium-containing compounds are useful as chemical sensitizers and are described in U.S. Pat. No. 6,423,481 (Simpson et al.). All of the above references are incorporated herein by reference.

In addition, sulfur-containing compounds can be decomposed on silver halide grains in an oxidizing environment. Examples of such sulfur-containing compounds include sulfur-containing spectral sensitizing dyes described in U.S. Pat. No. 5,891,615 (Winslow et al.) and diphenylphosphine sulfide compounds represented by the Structure (PS) described in copending and commonly assigned U.S. Ser. No. 10/731,251 (filed Dec. 9, 2003 by Simpson, Burleva, and Sakizadeh), both of which are incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic materials may be spectrally sensitized with one or more spectral sensitizing dyes that are known to enhance silver halide sensitivity to ultraviolet, visible, and/or infrared radiation. Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved. In some embodiments, spectral sensitization is desired to a wavelength of from about 300 to about 450 nm, and in preferred embodiments, the spectral sensitization is from about 360 to about 450 nm, and more preferably from about 380 to about 420 nm. A skilled worker would know how to choose the spectral sensitizing dyes best for these embodiments.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), and Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), can be used in the practice of the invention. All of the publications noted above are incorporated herein by reference. Useful spectral sensitizing dyes are also described in *Research Disclosure*, item 308119, Section IV, December, 1989.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.), and Japanese Kokai 2001-109101 (Adachi), 2001-154305 (Kita et al.), and 2001-183770 (Hanyu et al.).

Dyes may also be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the thermally developable materials can be any metal-organic compound that contains reducible silver(I) ions. Such compounds are generally organic silver salts of organic silver coordinating ligands that are comparatively stable to light and form a silver image when heated to 50° C. or higher in the presence of an exposed silver halide (for photothermographic materials) and a reducing agent.

Silver salts of nitrogen-containing heterocyclic compounds are preferred, and one or more silver salts of heterocyclic compounds containing an imino group are particularly preferred. Representative compounds of this type include, but are not limited to, silver salts of benzotriazole and substituted derivatives thereof (for example, silver methylbenzotriazole and silver 5-chloro-benzotriazole), silver salts of 1,2,4-triazoles or 1-H-tetrazoles such as phenylmercaptotetrazole as described in U.S. Pat. No. 4,220,709 (deMauriac), and silver salts of imidazole and imidazole derivatives as described in U.S. Pat. No. 4,260,677 (Winslow et al.). Particularly useful silver salts of this type are the silver salts of benzotriazole, substituted derivatives thereof, or mixtures of two or more of these salts. A silver salt of benzotriazole is most preferred in the photo-thermographic emulsions and materials.

Other silver salts can be used if present in "minor" amounts (less than 50 mol %) based on the total moles of organic silver salts.

Silver salts of heterocyclic compounds containing mercapto or thione groups and derivatives thereof can also be used. Such heterocyclic nuclei include, but are not limited to, triazoles, oxazoles, thiazoles, thiazolines, imidazoles, diazoles, pyridines, and triazines as described in U.S. Pat. No. 4,123,274 (Knight et al.) and U.S. Pat. No. 3,785,830 (Sullivan et al.). Examples of other useful silver salts of mercapto or thione substituted compounds that do not contain a heterocyclic nucleus include silver salts of thioglycolic acids, silver salts of dithiocarboxylic acids, and silver salts of thioamides.

Silver salts of organic acids including silver salts of long-chain aliphatic or aromatic carboxylic acids may also be included in minor amounts. The chains typically contain 10 to 30, and preferably 15 to 28, carbon atoms. Silver behenate is a preferred silver carboxylate alone or mixed with other silver carboxylates.

Sources of reducible silver ions can also be core-shell silver salts as described in U.S. Pat. No. 6,355,408 (Whitcomb et al.), that is incorporated herein by reference wherein a core has one or more silver salts and a shell has one or more different silver salts.

Other useful sources of non-photosensitive reducible silver ions are the silver dimer compounds that comprise two different silver salts as described in U.S. Pat. No. 6,566,045 (Whitcomb), that is incorporated herein by reference.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Patent Application Publication 2004/0023164 (Bokhonov et al.) that is incorporated herein by reference.

The one or more non-photosensitive sources of reducible silver ions are preferably present in an amount of about 5% by weight to about 70% by weight, and more preferably, about 10% to about 50% by weight, based on the total dry weight of the emulsion layers. Alternatively, the amount of the sources of reducible silver ions is generally present in an amount of from about 0.001 to about 0.2 mol/m$^2$ of the dry material (preferably from about 0.01 to about 0.05 mol/m$^2$).

The total amount of silver (from all silver sources) in the thermally developable imaging materials is generally at least 0.002 mol/m$^2$ and preferably from about 0.01 to about 0.05 mol/m$^2$.

Reducing Agents

The predominant reducing agents (or "developers") useful in this invention are ascorbic acid compounds (or derivatives) or reductones.

An "ascorbic acid" reducing agent means ascorbic acid, complexes thereof, and derivatives thereof. Ascorbic acid reducing agents are described in a considerable number of publications in photographic processes, including U.S. Pat. No. 5,236,816 (Purol et al.) and references cited therein.

Useful ascorbic acid reducing agents include ascorbic acid and the analogues, isomers, complexes, and derivatives thereof. Such compounds include, but are not limited to, D- or L-ascorbic acid, 2,3-dihydroxy-2-cyclohexen-1-one, 3,4-dihydroxy-5-phenyl-2(5H)-furanone, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, niacinamide ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in EP 0 585 792 A1 (Passarella et al.), EP 0 573 700 A1 (Lingier et al.), EP 0 588 408 A1 (Hieronymus et al.), U.S. Pat. No. 5,498,511 (Yamashita et al.), U.S. Pat. No. 5,089,819 (Knapp), U.S. Pat. No. 5,278,035 (Knapp), U.S. Pat. No. 5,384,232 (Bishop et al.), U.S. Pat. No. 2,688,549 (James et al.), and U.S. Pat. No. 5,376,510 (Parker et al.), J P Kokai 7-56286 (Toyoda); and *Research Disclosure*, publication 37152, March 1995. Mixtures of these developing agents can be used if desired.

Particularly useful reducing agents are ascorbic acid mono- or di-fatty acid esters such as the monolaurate, monomyristate, monopalmitate, monostearate, monobehenate, diluarate, distearate, dipalmitate, dibehenate, and dimyristate derivatives of ascorbic acid as described in U.S. Pat. No. 3,832,186 (Masuda et al.) and U.S. Pat. No. 6,309,814 (Ito). A most preferred reducing acid of this type is 1-ascorbyl palmitate [or L-ascorbic acid, 6-(2,2-dimethylpropanoate)].

Also useful are ascorbic acid derivatives that are represented by the following Structure (I):

(I)

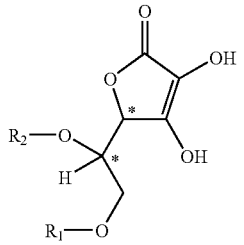

wherein $R_1$ and $R_2$ are independently hydrogen and/or the same or different acyl groups [$R_3$—(C═O)— or $R_3$—L—(C═O)—], provided that $R_1$ and $R_2$ are not both hydrogen. The acyl groups each have 11 or fewer carbon atoms, and preferably each acyl group is branched and/or contains at least one ring. The acyl groups may be substituted with functional groups such as ethers, halogens, esters and amides.

$R_3$ of the acyl group may be hydrogen, or a substituted or unsubstituted alkyl group having 10 or fewer carbon atoms (such as methyl, ethyl, iso-propyl, t-butyl, and benzyl), substituted or unsubstituted aryl having 6 to 10 carbon atoms in the carbocyclic ring (such as phenyl, 4-methylphenyl, 4-methoxy-phenyl, and naphthyl), substituted or unsubstituted alkenyl having 10 or fewer carbon atoms in the chain (such as ethenyl, hexenyl, and 1-methylpropenyl), or a substituted or unsubstituted heterocyclic group having 5 to 7 nitrogen, oxygen, sulfur, and carbon atoms in the heterocyclic ring (such as tetrahydrofuryl and benzthiazoyl). L may be oxy, thio, or —$NR_4$—, wherein $R_4$ is defined in the same way as $R_3$.

At least one of $R_1$ and $R_2$ is an acyl group and the other of $R_1$ and $R_2$ is preferably hydrogen. Preferably, $R_3$ is tert-butyl, $R_4$ is hydrogen, and L is nitrogen.

Mixtures of these compounds can be used if desired in any specific proportion.

Compounds of Structure I have two chiral centers (indicated by *) Therefore four isomers are possible and compounds of Structure I may be derived from D- or L-ascorbic acid or from D- or L-isoascorbic acid.

Representative examples of compounds having Structure I are shown below in TABLE I.

TABLE I

| Compound | Derived From | $R_1$ | $R_2$ |
|---|---|---|---|
| I-1 | L-ascorbic acid | t-Butyl-(C═O)— | H |
| I-2 | D-isoascorbic acid | t-Butyl-(C═O)— | H |
| I-3 | L-ascorbic acid | t-Butyl-(C═O)— | t-Butyl-(C═O)— |
| I-4 | D-isoascorbic acid | t-Butyl-(C═O)— | t-Butyl-(C═O)— |
| I-5 | D-isoascorbic acid | H | t-Butyl-(C═O)— |
| I-6 | L-ascorbic acid | i-Propyl-(C═O)— | H |
| I-7 | L-ascorbic acid | Ph—(C═O)— | H |
| I-8 | L-ascorbic acid | 1-Adamantyl-(C═O)— | H |
| I-9 | L-ascorbic acid | 1-Adamantylmethyl-(C═O)— | H |
| I-10 | L-ascorbic acid | 1-Methylcyclohexyl-(C═O)— | H |
| I-11 | L-ascorbic acid | 2-Adamantylmethyl-(C═O) | H |
| I-12 | L-ascorbic acid | 2,2-Dimethylpropyl-(C═O)— | H |
| I-13 | L-ascorbic acid | Cyclohexyl-(C═O)— | H |
| I-14 | L-ascorbic acid | 1,1-Dimethylpropyl-(C═O)— | H |
| I-15 | L-ascorbic acid | 1-Ethylpropyl-(C═O)— | H |
| I-16 | L-ascorbic acid | 2,4,4-Trimethylpentyl-(C═O)— | H |
| I-17 | L-ascorbic acid | 2-Methylpropyl-(C═O)— | H |
| I-18 | L-ascorbic acid | Cyclopentyl-(C═O)— | H |
| I-19 | L-ascorbic acid | Diethylamino-(C═O) | H |
| I-20 | L-ascorbic acid | Diethylamino-(C═O)— | Diethylamino-(C═O)— |

TABLE I-continued

| Compound | Derived From | $R_1$ | $R_2$ |
|---|---|---|---|
| I-21 | L-ascorbic acid | Phenyl-NH—(C═O)— | H |
| I-22 | L-ascorbic acid | Hexyl-NH—(C═O)— | Hexyl-NH—(C═O)— |
| I-23 | L-ascorbic acid | t-Butyl-(C═O)— | Ethyl-(C═O)— |
| I-24 | L-ascorbic acid | Ethyl-(C═O)— | Ethyl-(C═O)— |
| I-25 | L-ascorbic acid | Ethyl-O—(C═O)— | H |
| I-26 | L-ascorbic acid | Phenyl-O—(C═O)— | H |
| I-27 | L-ascorbic acid | 4-HO-Phenyl-(C═O)— | H |
| I-28 | L-ascorbic acid | 2-norbornylmethyl-(C═O)— | H |
| I-29 | L-ascorbic acid | 3,4-$(HO)_2$—Phenyl-(C═O)— | H |
| I-30 | L-ascorbic acid | i-Propyl-(C═O)— | i-Propyl-(C═O)— |
| I-31 | L-ascorbic acid | Ethyl-(C═O)— | Ethyl-(C═O)— |

Compounds of Structure I may be prepared by known methods. For example, 5- and/or 6-substituted esters of ascorbic acid may be prepared by the reaction of ascorbic acid and a carboxylic acid in sulfuric acid as described by H. Tanaka and R. Yamamoto, *Yakugaku Zasshi,* 1966, 86(5), 376–83.

A "reductone" reducing agent means a class of unsaturated, di- or poly-enolic organic compounds which, by virtue of the arrangement of the enolic hydroxyl groups with respect to the unsaturated linkages, possess characteristic strong reducing power. The parent compound, "reductone" is 3-hydroxy-2-oxo-propionaldehyde (enol form) and has the structure HOCH═CH(OH)—CHO. In some reductones, an amino group, a mono-substituted amino group or an imino group may replace one or more of the enolic hydroxyl groups without affecting the characteristic reducing behavior of the compound.

Reductone developing agents are described in a considerable number of publications in photographic processes, including U.S. Pat. No. 2,691,589 (Henn et al), U.S. Pat. No. 3,615,440 (Bloom), U.S. Pat. No. 3,664,835 (Youngquist et al.), U.S. Pat. No. 3,672,896 (Gabrielson et al.), U.S. Pat. No. 3,690,872 (Gabrielson et al.), U.S. Pat. No. 3,816,137 (Gabrielson et al.), U.S. Pat. No. 4,371,603 (Bartels-Keith et al.), U.S. Pat. No. 5,712,081 (Andriesen et al.), and U.S. Pat. No. 5,427,905 (Freedman et al.), all of which references are incorporated herein by reference.

Minor (less than 20 mol % of total moles of reducing agents) of conventional reducing agents (such hindered phenols) can be used in combination with the ascorbic acid reducing agents if desired, but it is preferred that the thermally developable materials contain one or more ascorbic acids or reductones as the exclusive reducing agents.

If desired, co-developers and contrast enhancing agents may be used in combination with the ascorbic acid and reductone reducing agents described herein. Useful co-developer reducing agents include for example, those described in U.S. Pat. No. 6,387,605 (Lynch et al.) that is incorporated herein by reference.

Additional classes of reducing agents that may be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are identified as HET-01 and HET-02 in U.S. Pat. No. 5,635,339 (Murray) and CN-01 through CN-13 in U.S. Pat. No. 5,545,515 (Murray et al.), both patents incorporated herein by reference.

Various contrast enhancing agents may be used in some photo-thermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described in U.S. Pat. No. 5,545,505 (Simpson), hydroxamic acid compounds as described in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

The ascorbic acid or reductone reducing agent (or mixture thereof) is generally present in the thermally developable materials in an amount of from about 0.3 to about 1.0 mol/mol of total silver, or in an amount of from about 0.002 to about 0.05 mol/$m^2$ (preferably from about 0.006 to about 0.03 mol/$m^2$).

Other Addenda

The thermally developable materials can also include one or more compounds that are known in the art as "toners." Toners are compounds that when added to the imaging layer shift the color of the developed silver image from yellowish-orange to brown-black or blue-black, and/or act as development accelerators to speed up thermal development. "Toners" or derivatives thereof that improve the black-and-white image are highly desirable components of the thermally developable materials.

Thus, compounds that either act as toners or react with a reducing agent to provide toners can be present in an amount of about 0.01% by weight to about 10% (preferably from about 0.1% to about 10% by weight) based on the total dry weight of the layer in which they are included. The amount can also be defined as being within the range of from about $1\times10^{-5}$ to about 1.0 mol per mole of non-photosensitive source of reducible silver in the photothermographic material. The toner compounds may be incorporated in one or more of the thermally developable layers as well as in adjacent layers such as the outermost protective layer or underlying "carrier" layer. Toners can be located on both sides of the support if thermally developable layers are present on both sides of the support.

Compounds useful as toners are described in U.S. Pat. No. 3,074,809 (Owen), U.S. Pat. No. 3,080,254 (Grant, Jr.), U.S. Pat. No. 3,446,648 (Workman), U.S. Pat. No. 3,844,797 (Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282 (Winslow), U.S. Pat. No. 5,599,647 (Defieuw et al.), and U.S. Pat. No. 3,832,186 (Masuda et al.), and GB 1,439,478 (AGFA).

Particularly useful toners are mercaptotriazoles as described in U.S. Pat. No. 6,713,240 (Lynch et al.), the heterocyclic disulfide compounds described in U.S. Pat. No. 6,737,227 (Lynch et al.), the triazine-thione compounds described in U.S. Pat. No. 6,703,191 (Lynch et al.). All of the above are incorporated herein by reference. The mercaptotriazoles are most preferred.

Also useful as toners are phthalazine and phthalazine derivatives [such as those described in U.S. Pat. No. 6,146,822 (Asanuma et al.) incorporated herein by reference], phthalazinone, and phthalazinone derivatives as well as phthalazinium compounds [such as those described in U.S. Pat. No. 6,605,418 (Ramsden et al.), incorporated herein by reference].

The thermally developable materials can also contain other additives, where appropriate, such as shelf-life stabilizers, antifoggants, contrast enhancing agents, development accelerators, acutance dyes, post-processing stabilizers or stabilizer precursors, thermal solvents (also known as melt formers), humectants, and other image-modifying agents as would be readily apparent to one skilled in the art.

To further control the properties of photothermographic materials (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused hetero-aromatic ring containing one or more of nitrogen, sulfur, oxygen, selenium, or tellurium atoms. Useful heteroaromatic mercapto compounds are described as supersensitizers in EP 0 559 228 B1 (Philip, Jr. et al.).

The photothermographic materials can be further protected against the production of fog and can be stabilized against loss of sensitivity during storage. Suitable antifoggants and stabilizers that can be used alone or in combination include thiazolium salts as described in U.S. Pat. No. 2,131,038 (Brooker et al.) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), oximes as described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described in U.S. Pat. No. 5,594,143 (Kirk et al.) and U.S. Pat. No. 5,374,514 (Kirk et al.), and 2-(tribromomethylsulfonyl) quinoline compounds as described in U.S. Pat. No. 5,460,938 (Kirk et al.).

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles (for example alkylsulfonylbenzotriazoles and arylsulfonylbenzotriazoles) have been found to be useful for post-processing print stabilizing as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, et al.), diisocyanate compounds as described in EP 0 600 586A1 (Philip et al.), and tribromomethylketones as described in EP 0 600 587A1 (Oliffet al.).

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants of this type are polyhalo antifoggants, such as those having a —$SO_2C(X')_3$ group wherein X' represents the same or different halogen atoms.

Another class of useful antifoggants includes those compounds described in U.S. Pat. No. 6,514,678 (Burgmaier et al.), incorporated herein by reference.

Advantageously, the photothermographic materials also include one or more thermal solvents (also called "heat solvents," "thermosolvents," "melt formers," "melt modifiers," "eutectic formers," "development modifiers," "waxes," or "plasticizers").

By the term "thermal solvent" is meant an organic material that becomes a plasticizer or liquid solvent for at least one of the imaging layers upon heating at a temperature above 60° C. Useful for that purpose are polyethylene glycols having a mean molecular weight in the range of 1,500 to 20,000 described in U.S. Pat. No. 3,347,675 (Henn et al.), urea, methyl sulfonamide and ethylene carbonate as described in U.S. Pat. No. 3,667,959 (Bojara et al.), and compounds described as thermal solvents in *Research Disclosure*, December 1976, item 15027, pp. 26–28. Other representative examples of such compounds include, but are not limited to, niacinamide, hydantoin, 5,5-dimethylhydantoin, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, 1,3-dimethylurea, 1,3-diethylurea, 1,3-diallylurea, meso-erythritol, D-sorbitol, tetrahydro-2-pyrimidone, glycouril, 2-imidazolidone, 2-imidazolidone-4-carboxylic acid, and benzenesulfonamide. Combinations of these compounds can also be used including, for example, a combination of succinimide and 1,3-dimethylurea.

It may be advantageous to include a base-release agent or base precursor in the photothermographic materials. Representative base-release agents or base precursors include guanidinium compounds, such as guanidinium trichloroacetate, and other compounds that are known to release a base but do not adversely affect photographic silver halide materials, such as phenylsulfonyl acetates as described in U.S. Pat. No. 4,123,274 (Knight et al.).

In some embodiments, it is also effective to incorporate X-radiation-sensitive phosphors in the chemically sensitized photothermographic materials as described in U.S. Pat. No. 6,573,033 (Simpson et al.) and U.S. Pat. No. 6,440,649 (Simpson et al.), both of which are incorporated herein by reference. Any conventional or useful storage or prompt-emitting phosphor can be used, singly or in mixtures. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Ser. No. 10/826,500 (filed Apr. 16, 2004 by Simpson, Sieber, and Hansen).

The one or more phosphors can be present in the photothermographic materials in an amount of at least 0.1 mole, and preferably from about 0.5 to about 20 mole, per mole of total silver in the photothermographic material. Generally, the amount of total silver is at least 0.002 mol/$m^2$. Most preferably, the one or more phosphors and the photosensitive silver halide are incorporated within the same imaging layer that has a dry coating weight within the noted preferred range.

Binders

The photosensitive silver halide (if present), the non-photosensitive source of reducible silver ions, the ascorbic acid or reductone reducing agent, antifoggant(s), toner(s), and any other additives are added to and coated in one or more binders using a suitable solvent. Thus, organic solvent-based or aqueous-based formulations are used to prepare the thermally developable materials. Mixtures of different types of hydrophilic and/or hydrophobic binders can also be used. Preferably, hydrophilic binders and water-dispersible latex polymers are used to provide aqueous-based formulations and thermally developable materials.

Examples of useful hydrophilic binders include, but are not limited to, proteins and protein derivatives, gelatin and gelatin derivatives (hardened or unhardened), cellulosic materials, acrylamide or methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides, and other naturally occurring or synthetic vehicles commonly known for use in aqueous-based photographic emulsions (see for example *Research Disclosure*, item 38957, noted above).

Particularly useful hydrophilic binders are gelatin, gelatin derivatives, polyvinyl alcohols, and cellulosic materials. Gelatin and its derivatives are most preferred, and comprise at least 75 weight % of total binders when a mixture of binders is used.

Aqueous dispersions of water-dispersible latex polymers may also be used, alone or with hydrophilic or hydrophobic binders described herein. Such dispersions are described in U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al.), and U.S. Pat. No. 6,423,487 (Naoi), all of which are incorporated herein by reference.

In less preferred embodiments, the components needed for imaging can be added to one or more binders that are predominantly (at least 50% by weight of total binders) hydrophobic in nature. Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available under the name BUTVAR® from Solutia, Inc. (St. Louis, Mo.) and PIOLOFORM® from Wacker Chemical Company (Adrian, Mich.) and cellulose ester polymers.

Hardeners for various binders may be present if desired. Useful hardeners are well known and include diisocyanate compounds as described for example, in EP 0 600 586B1 (Philip et al.) and vinyl sulfone compounds as described in U.S. Pat. No. 6,143,487 (Philip et al.), and EP 0 640 589A1 (Gathmann et al.), aldehydes and various other hardeners as described in U.S. Pat. No. 6,190,822 (Dickerson et al.).

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of about 10% by weight to about 90% by weight, and more preferably at a level of about 20% by weight to about 70% by weight, based on the total dry weight of the layer in which it is included. The amount of binders on opposing sides of the support in double-sided materials may be the same or different.

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use supports comprising dichroic mirror layers as described in U.S. Pat. No. 5,795,708 (Boutet), incorporated herein by reference.

Also useful are transparent, multilayer, polymeric supports comprising numerous alternating layers of at least two different polymeric materials that preferably reflect at least 50% of actinic radiation in the range of wavelengths to which the photothermographic material is sensitive as described in U.S. Pat. No. 6,630,283 (Simpson et al.) that is incorporated herein by reference.

Support materials can contain various colorants, pigments, antihalation or acutance dyes if desired. For example, blue-tinted supports are particularly useful for providing images useful for medical diagnosis. Support materials may be treated using conventional procedures (such as corona discharge) to improve adhesion of overlying layers, or subbing or other adhesion-promoting layers can be used.

Photothermographic Formulations

An organic solvent-based coating formulation for the emulsion layer(s) can be prepared by mixing the emulsion components with one or more hydrophobic binders in a suitable solvent system that usually includes an organic solvent, such as toluene, 2-butanone (methyl ethyl ketone), acetone, or tetrahydrofuran.

Alternatively and preferably, the emulsion components are prepared in an aqueous formulation containing a hydrophilic binder (such as gelatin, a gelatin-derivative, or a cellulosic material) or a water-dispersible latex polymer in water or water-organic solvent mixtures to provide aqueous-based coating formulations.

The thermally developable materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic or organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The thermally developable materials can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.).

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.).

Additional conductive compositions include one or more fluoro-chemicals are described in more detail in U.S. Pat. No. 6,762,013 (Sakizadeh et al.).

Layers to promote adhesion of one layer to another are also known, as described in U.S. Pat. No. 5,891,610 (Bauer et al.), U.S. Pat. No. 5,804,365 (Bauer et al.), U.S. Pat. No. 4,741,992 (Przezdziecki), and U.S. Pat. No. 5,928,857 (Geisler et al.).

The formulations described herein (including the thermally developable formulations) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

For example, after or simultaneously with application of the emulsion formulation to the support, the outermost overcoat formulation described below can be applied over the emulsion formulation(s).

Preferably, two or more layer formulations are applied simultaneously to a film support using slide coating, the first layer being coated on top of the second layer while the second layer is still wet, using the same or different solvents.

In other embodiments, a "carrier" layer formulation comprising a single-phase mixture of the two or more polymers described above may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the emulsion layer formulation(s).

Mottle and other surface anomalies can be reduced in the materials by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

While the first and second layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

It is also particularly contemplated that the thermally developable materials can include emulsion layers on both sides of the support and/or an antihalation underlayer beneath at least one emulsion layer. Thus, the outermost protective layers described below can be disposed on both sides of the support.

To promote image sharpness, photothermographic materials can contain one or more layers containing acutance and/or antihalation dyes. These dyes are chosen to have absorption close to the exposure wavelength and are designed to absorb scattered light. One or more antihalation compositions may be incorporated into one or more antihalation backing layers, underlayers, or overcoats. Additionally, one or more acutance dyes may be incorporated into one or more frontside layers.

Dyes useful as antihalation and acutance dyes include squaraine dyes described in U.S. Pat. No. 5,380,635 (Gomez et al.) and U.S. Pat. No. 6,063,560 (Suzuki et al.), and EP 1 083 459A1 (Kimura), indolenine dyes described in EP 0 342 810A1 (Leichter), and cyanine dyes described in U.S. Pat. No. 6,689,547 (Hunt et al.).

It may also be useful to employ compositions including acutance or antihalation dyes that will decolorize or bleach with heat during processing as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japanese Kokai 2001-142175 (Hanyu et al.) and 2001-183770 (Hanye et al.). Useful bleaching compositions are described in Japanese Kokai 11-302550 (Fujiwara), 2001-109101 (Adachi), 2001-51371 (Yabuki et al.), and 2000-029168 (Noro).

Other useful heat-bleachable backside antihalation compositions can include a radiation absorbing compound such as an oxonol dye and various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.).

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Outermost Protective Layer

The thermally developable materials include an outermost (surface) protective layer over one or more thermally developable imaging layers on one or both sides of the support. In some embodiments, the materials include an outermost protective layer on the same side of the support as the one or more imaging layers and a different layer on the backside that includes an antihalation and/or conductive antistatic composition, with or without a separate backside surface protective layer. Preferably, the outermost protective layer as described below is disposed over thermally developable imaging layers on both sides of the support.

Preferably, the outermost protective layer is directly disposed over the one or more thermally developable imaging layers, meaning that there are no intermediate or interlayers between imaging layers and outermost protective layer. However, there may be a non-imaging interlayer between the imaging layers and the outermost protective layer.

The outermost protective layer has a surface pH less than 6, preferably of from about 4.0 to about 5.0, and more preferably from about 4.2 to about 4.6. Surface pH can be measured by adding a drop of 0.3 M $KNO_3$ to the surface of the test sample that is then brought into contact with a conventional electrode surface (both the pH and reference junctions of the combination pH electrode). The electrode is generally equilibrated within 60 seconds and a pH value is recorded after 120 seconds at 22° C. Calibration of the pH meter can be performed using standard pH 7 and pH 4 solutions.

The outermost protective layer over the one or more imaging layers comprises one or more film-forming negatively-charged latex polymers as the predominant film-forming components. By "predominant" is meant that the negatively-charged latex polymer(s) comprise at least 50% (preferably from about 70 to about 95%, and more preferably from about 80 to about 95%) of the total dry weight of film-forming components in the protective layer. Such latex polymers comprise from about 0.4 to about 20 mol % (preferably from about 0.4 to about 15 mol % and more preferably from about 0.4 to about 10 mol %) of recurring units derived from ethylenically unsaturated polymerizable monomers comprising one or more sulfate, sulfonates, phosphate, or phosphonate groups, or their conjugate acids. Latex polymers having sulfonates group (or conjugate acid salts thereof) are preferred. None of the negatively-charged latex polymers used in the present invention purposely contain limited or no carboxy groups (or equivalent carboxy precursor groups such as anhydrides.).

The preferred negatively-charged latex polymers can be more specifically defined by the following Structure (II):

$$\text{-}(A)_x\text{-}(B)_y\text{-} \qquad \text{(II)}$$

wherein A represents recurring units comprising a sulfate, sulfonates, phosphate, or phosphonate group (or conjugate acid), B represents recurring units derived from a non-charged ethylenically unsaturated polymerizable monomer, x is from about 0.4 to about 20 mol % (preferably from about 0.4 to about 15 mol % and more preferably from about 0.4 to about 10 mol %), and y is from about 80 to about 99.6 mol % (preferably from about 85 to about 99.6 mol % and more preferably from about 90 to about 99.6 mol %).

The A recurring units can be derived from a variety of known negatively-charged ethylenically unsaturated polymerizable monomers including the acid and conjugate base forms of:

2-phosphatoethyl acrylate and 3-phosphatopropyl methacrylate salts, and other acrylic and methacrylic esters and amides of alkylphosphonates and phosphates in which the alkyl group connecting the acrylic function to the phosphate or phosphonate function can be ≧2 carbon atoms long, salts of vinylphosphonic acid, 2-sulfoethyl acrylate and 3-sulfopropyl methacrylate salts, and other acrylic and methacrylic esters and amides of alkylsulfonates and sulfates in which the alkyl group connecting the acrylic function to the phosphate or phosphonate function can be ≧2 carbon atoms long, ethylene sulfonic acid salts, styrene sulfonic acid salts, sodium 1-methylvinylphosphonate, sodium vinyl sulfonate, sodium 1-methylvinyl-sulfonate, sodium styrenesulfonate, sodium acrylamidopropanesulfonate, sodium methacrylamidopropanesulfonate, and sodium vinyl morpholine sulfonate. For all of the salts mentioned, the counter ions can be protons (i.e. conjugate acid form), alkali metal cations, quaternary ammonium cations, phosphonium cations, sulfonium cations, or positively charged aromatic heterocycles, such as pyridinium ions.

In addition, A can be derived from ethylenically unsaturated polymerizable monomers to which the requisite sulfate, sulfonates, phosphate, or phosphonate groups (or conjugate acids) can be attached after polymerization. For example, sulfonate groups can be introduced into a polymer by the reaction of bisulfite or sulfite anion with glycidyl residues or with chloromethyl residues as described for example in and in *J. Appl. Polym. Sci.* V. 25 p. 2407 (1980). Similarly, phosphonates can be prepared by the reaction of trialkyl phosphites with leaving group containing monomer residues (such as vinylbenzyl chloride or p-bromostyrene) followed by hydrolysis.

The B recurring units can be derived from a wide variety of known nonionic ethylenically unsaturated polymerizable monomers as long as the resulting polymers are film-forming and compatible with the other components needed for the outermost protective layer. Such monomers include: methacrylic acid esters, such as methyl methacrylate, ethyl methacrylate, isobutyl methacrylate, 2-ethylhexyl methacrylate, benzyl methacrylate, phenoxyethyl methacrylate, cyclohexyl methacrylate and glycidyl methacrylate, acrylate esters such as methyl acrylate, ethyl acrylate, n-butyl acrylate, iso-butyl acrylate, 2-ethylhexyl acrylate, benzyl methacrylate, phenoxyethyl acrylate, cyclohexyl acrylate, and glycidyl acrylate, styrenics such as styrene, α-methylstyrene, 3- and 4-chloromethylstyrene, halogen-substituted styrenes, and alkyl-substituted styrenes, vinyl halides and vinylidene halides, N-alkylated acrylamides and methacrylamides, vinyl esters such as vinyl acetate and vinyl benzoate, vinyl ether, allyl alcohol and its ethers and esters, and unsaturated ketones and aldehydes such as acrolein and methyl vinyl ketone, isoprene, butadiene and cyanoacrylate esters.

The preferred monomers from which the B recurring units are derived include acrylate and methacrylate esters and styrenics.

Particularly useful negative-charged latex polymers include (molar ratios would be determined according to the teaching noted above):

poly(methyl methacrylate-co-n-butyl acrylate-co-sodium 2-acrylamido-2-methyl-1-propanesulfonate), poly(methyl methacrylate-co-n-butyl acrylate-co-vinyl phosphonic acid, disodium salt), poly(methyl methacrylate-n-butyl acrylate-co-potassium 3-sulfopropylmethacrylate), poly(styrene-co-ethylhexyl methacrylate-co-sodium 2-acrylamido-2-methyl-1-propanesulfonate), poly(acrylonitrile-co-ethylhexyl acrylate-co-sodium styrene sulfonate), poly(styrene-co-butadiene-co-sodium styrene sulfonate), and poly(ethylene-co-vinyl acetate-co-potassium 3-sulfopropyl methacrylamide).

Invention Polymers 1–5 noted below are preferred and Invention Polymer 1 is most preferred.

The negatively-charged latex polymers are prepared using conventional emulsion polymerization techniques and representative synthetic methods are described below. With this teaching, adaptations for making other useful latex polymers would be readily apparent to one skilled in the art using known starting materials and reaction conditions. The resulting latex polymer particles generally have a volume average particle size of less than 2 μm, and preferably a volume average particle size of from about 0.02 to about 0.5 μm, as measured using conventional equipment such as an Ultrafine Particle Analyzer (Microtrac, Inc.).

The negatively-charged latex polymers also generally have a glass transition temperature of from about −20 to about +50° C., and preferably from about 10 to about 40° C., as measured by differential scanning calorimetry.

One or more non-ionic stabilizers are preferably used to prepare the negative-charged polymers described herein. These stabilizers are mixed with the appropriate ethylenically unsaturated polymerizable monomers at any suitable time during polymerization and they become "associated" with the particles of negatively-charged latex polymer. By "associated", we mean they become chemisorbed, physically adsorbed, covalently grafted, or arranged in a monolayer at the surface of the particle. While this stabilizer is usually associated with the latex polymer particles during polymer preparation, it can also be added after polymerization. Any non-ionic stabilizer can be used that has an HLB value of from about 7 to about 20 and preferably of from about 13 to about 19. The "HLB value" (or hydrophilic/lipophilic balance) is a known parameter that describes the relationship of hydrophobic and hydrophilic moieties in the same molecule and is commonly used to describe surfactants (or surface active agents), emulsifiers, detergents and dispersants. The HLB scale is defined and described in *J. Soc. Cosmetic Chemists* 1954, 5, 249 and *J. Soc. Cosmetic Chemists* 1949, 1, 311.

Particularly useful non-ionic stabilizers include the following classes of compounds: alkyl phenol ethoxylates (such as the TRITON® surfactants sold by Union Carbide), alkylphenol-polyglycerols, hydrophobe-end capped oligoacrylamides, such as those described in U.S. Pat. No. 6,127,453 (Erdtmann et al.), polyethylene oxide-co-polypropylene oxide block copolymers, such as those sold under the PLURONIC® and TECTRONIC® trade names and branched and unbranched alkane modified polyethylene oxide surfactants such as those sold under the BRIJ® tradename. Many of these compounds are commercially available from such companies as Union Carbide, Olin Co., Stepan Co., BASF, and Solutia.

The nonionic stabilizer(s) is generally present during latex polymer preparation (while in aqueous dispersion) in an amount of from about 0.5 to about 10% (preferably at from about 0.5 to about 5%) based on the dry weight of negatively-charged latex polymer particles. If the latex polymer is purified (see below) in some fashion, the amount of nonionic stabilizer associated with the latex polymer particles may be reduced to as little as 0.005% and up to 1% based on the dry weight of the polymer particles.

After the negatively-charged polymer is prepared in a latex dispersion, it may be "purified" using any known procedure such as diafiltration and ultrafiltration. This purification will likely remove some of the stabilizer(s) originally present in the polymer latex but a sufficient amount of the stabilizer remains associated with the latex particles after conventional purification because it has been found that a "purified" polymer latex yields easily coated overcoat formulations that are free of gels, slugs, and coagulum. Comparable latex polymers of similar particle size and composition that are prepared in the absence of such stabilizer(s) (that is, using surfactant-free latex polymerization procedures), however, have been found to yield coagulated, partially gelled, or otherwise uncoatable formulations. Thus, some small or residual amount of nonionic surfactant remains adsorbed to the latex particles after purification and is necessary to obtain readily coated formulations.

The outermost protective layer can also include one or more additional film-forming components that are generally hydrophilic binders and/or water-dispersible latex polymers that are described in more detail above in relation to "Binders". These second film-forming components are different than but compatible with the negative-charged latex polymers. Particularly useful additional film-forming components include gelatin and gelatin derivatives, poly(vinyl alcohols), and non-ionic water-dispersible latex polymers. Gelatin and gelatin derivatives are particularly useful as the additional film-forming components.

The outermost protective layer can include addenda that may be useful for transport through imaging apparatus, light stability, or other properties, including conventional components such as lubricants, matting agents (both inorganic and organic polymer particles), slip agents, coating aids, and antimicrobials (or biocides). These optional addenda may be present in conventional amounts.

Imaging/Development

The photothermographic materials can be imaged in any suitable manner consistent with the type of material, using any suitable imaging source (typically some type of radiation or electronic signal). In some embodiments, the materials are sensitive to radiation in the range of from about at least 300 nm to about 1400 nm, and preferably from about 300 nm to about 850 nm because of the use of appropriate spectral sensitizing dyes. In one preferred embodiment, the materials are sensitive to radiation of from about 300 nm to about 450 nm.

Imaging can be achieved by exposing the photothermographic materials to a suitable source of radiation to which they are sensitive, including ultraviolet radiation, visible light, near infrared radiation and infrared radiation to provide a latent image. Suitable exposure means are well known and include incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure*, item 38957 (noted above).

In preferred embodiments, the photothermographic materials can be indirectly imaged using an X-radiation imaging source and one or more prompt-emitting or storage X-ray sensitive phosphor screens arranged adjacent to the photothermographic material. The phosphors emit suitable radiation to expose the photothermographic material.

In other embodiments, the photothermographic materials can be imaged directly using an X-radiation imaging source to provide a latent image.

In still other embodiments, the photothermographic materials can be directly imaged using an X-radiation imaging source and one or more X-ray sensitive prompt emitting or storage phosphors incorporated within the photothermographic material.

Imaging of the thermographic materials is carried out using a suitable imaging source of thermal energy such as a thermal print head.

Thermal development conditions will vary, depending on the construction used but will typically involve heating the thermally sensitive material at a suitably elevated temperature, for example, at from about 50° C. to about 250° C. for a sufficient period of time, generally from about 1 to about 120 seconds. Heating can be accomplished using any suitable heating means. A preferred heat development procedure for photothermographic materials includes heating at from 130° C. to about 170° C. for from about 10 to about 25 seconds. A particularly preferred development procedure is heating at about 150° C. for 15 to 25 seconds.

Use as a Photomask

The photothermographic and thermographic materials may be sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. These embodiments of the imaging method of this invention are carried out using the following Steps A through D for a photothermographic material (a similar method would be used for a thermographic material with conventional thermal imaging):

A) imagewise exposing the photothermographic material having a transparent support to form a latent image, B) simultaneously or sequentially, heating the exposed photothermographic material to develop the latent image into a visible image, C) positioning the exposed and photothermographic material with the visible image therein between a source of imaging radiation and an imageable material that is sensitive to the imaging radiation, and D) exposing the imageable material to the imaging radiation through the visible image in the exposed and photothermographic material to provide an image in the imageable material.

Imaging Assemblies

In preferred embodiments, the photothermographic materials are used in association with one or more phosphor intensifying screens and/or metal screens in what is known as "imaging assemblies." Double-sided X-radiation sensitive photothermographic materials are preferably used in combination with two adjacent intensifying screens, one screen in the "front" and one screen in the "back" of the material. The front and back screens can be appropriately chosen depending upon the type of emissions desired, the desired photicity, emulsion speeds, and percent crossover. A metal (such as copper or lead) screen can also be included if desired.

There are a wide variety of phosphors known in the art that can be formulated into phosphor intensifying screens as described in hundreds of publications including U.S. Pat. No. 6,573,033 (noted above) and references cited therein. Preferably, the phosphor is chosen to emit radiation of from about 300 to about 450 nm.

Imaging assemblies can be prepared by arranging a suitable photothermographic material in association with one or more phosphor intensifying screens, and one or more metal screens.

The following examples are provided to illustrate the practice of the present invention and the invention is not meant to be limited thereby.

Materials and Methods for the Examples:

All materials used in the following examples can be prepared using known synthetic procedures or are readily available from standard commercial sources, such as Aldrich Chemical Co. (Milwaukee, Wis.) unless otherwise specified. All percentages are by weight unless otherwise indicated.

Densitometry measurements were carried out on an X-Rite® Model 301 densitometer that is available from X-Rite Inc. (Grandville, Mich.).

ZONYL FS-300 and FSN are nonionic fluorosurfactants that are available from E. I. DuPont de Nemours & Co. (Wilmington, Del.).

Compound A-1 is described in U.S. Pat. No. 6,605,418 (noted above) and is believed to have the following structure:

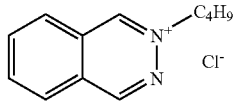

(A-1)

Compound SS-1a is described in U.S. Pat. No. 6,296,998 (Eikenberry et al.) and is believed to have the following structure.

(SS-1a)

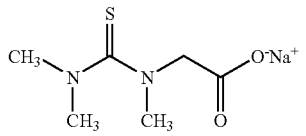

Blue sensitizing dye SSD-1 is believed to have the following structure.

(SSD-1)

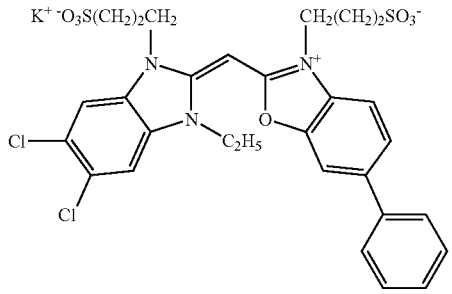

Preparation of Latex Polymers:

In the following preparations, all monomers and reagents were used as received from the suppliers with no further purification. Sodium 2-acrylamido-2-methyl-1-propanesulfonate was used as a 50% solution in water. Similarly, TRITON® X-405 surfactant (obtained from Rohm and Haas) and Olin 10G surfactant (obtained from the Olin Co.) were used as received as a 70% and 50% solution in water, respectively. The quantities reported for these reagents correspond to the solutions rather than the neat reagents. All percentages are weight percentages unless otherwise stated.

Invention Polymer 1

Poly(methyl methacrylate-co-n-butyl acrylate-co-sodium 2-acrylamido-2-methyl-1-propanesulfonate) (65.31:33.72:0.97 molar ratio) 2% nonionic surfactant (based on total weight of monomers)

A 3-neck, 3-liter round bottom flask outfitted with a mechanical stirrer, reflux condenser, and nitrogen inlet was charged with the following reagents: 11.06 g of methyl methacrylate, 7.31 g of butyl acrylate, 0.75 g of sodium 2-acrylamido-2-methyl-1-propanesulfonate, 743 ml of deionized water, 1.88 g of potassium persulfate, and 7.14 g of TRITON® X-405 nonionic surfactant. The seed mixture was bubble degassed with nitrogen for 20 minutes and was then placed in a heat-controlled water bath at 70° C. with 200 RPM stirring. After 20 minutes, a translucent bluish seed latex had formed. A 120-minute addition via solvent pumping of a rapidly stirred, bubble degassed "header" suspension consisting of 210.19 g of methyl methacrylate, 138.94 g of butyl acrylate, 14.25 g of sodium 2-acrylamido-2-methyl-1-propanesulfonate, 371.39 ml of deionized water, 1.88 g of potassium persulfate, and 3.57 g of TRITON® X-405 surfactant was then initiated. The reaction was allowed to proceed at 70° C. for 16 additional hours to provide a bluish-white latex that was nearly coagulum-free. The latex was poured through cheesecloth and dialyzed overnight using 14K cutoff dialysis tubing. The purified product latex (1805 g, 18.94% solids) had a volume-average particle diameter of about 0.15 μm (as measured by photon correlation spectroscopy using an Ultrafine Particle Analyzer).

Invention Polymer 2

Poly(methyl methacrylate-co-n-butyl acrylate-co-sodium 2-acrylamido-2-methyl-1-propanesulfonate) (55.87:43.64:0.49 molar ratio) 1% nonionic surfactant (based on total monomer weight)

This latex was prepared by an identical procedure as that described for Invention Polymer 1. The initial (seed) charge consisted of 8.66 g of methyl methacrylate, 8.66 g of butyl acrylate, 0.35 g of sodium 2-acrylamido-2-methyl-1-propanesulfonate, 696.70 ml of deionized water, 1.88 g of potassium persulfate, and 3.33 g of TRITON® X-405 nonionic surfactant. The header consisted of 164.59 g of methyl methacrylate, 164.59 g of butyl acrylate, 6.65 g of sodium 2-acrylamido-2-methyl-1-propanesulfonate, 348.30 ml of deionized water, 1.88 g of potassium persulfate, and 1.67 g of TRITON® X-405 nonionic surfactant. The product latex (1341 g, 25.77% solids) had a volume average particle diameter of about 0.20 μm (determined as for Invention Polymer 1).

Invention Polymer 3

Poly(methyl methacrylate-co-n-butyl acrylate-co-vinyl phosphonic acid disodium salt) (64.04:39.92:3.04 molar ratio) 2% nonionic surfactant (based on total monomer weight)

This latex was prepared by an identical procedure as that described for Invention Polymer 1. The initial (seed) charge consisted of 10.97 g of methyl methacrylate, 7.22 g of butyl acrylate, 0.56 g of vinyl phosphonic acid, 747.89 ml of deionized water, 1.88 g of potassium persulfate, 7.14 g of TRITON® X-705 nonionic surfactant, and 0.52 g of sodium hydroxide (pellets). The header consisted of 208.41 g of methyl methacrylate, 137.16 g of butyl acrylate, 10.69 g of vinyl phosphonic acid, 373.89 ml of deionized water, 1.88 g of potassium persulfate, 9.89 g of sodium hydroxide (pellets), and 3.57 g of TRITON® X-705 nonionic surfactant. The product latex (2525.7 g, 13.67% solids) had a volume average particle diameter of about 0.24 μm (determined as for Invention Polymer 1). The increased dilution of this latex was due to the accumulation of extra water during the dialysis process.

Invention Polymer 4

Poly(methyl methacrylate-co-n-butyl acrylate-co-potassium-3-sulfopropylmethacrylate) (65.15:33.49:1.36 molar ratio) 2% nonionic surfactant (based on total monomer weight)

This latex was prepared by an identical procedure as that described for Invention Polymer 1. The initial (seed) charge consisted of 10.97 g of methyl methacrylate, 7.22 g of butyl acrylate, 0.56 g of potassium-3-sulfopropylmethacrylate, 747.89 ml of deionized water, 1.88 g of potassium persulfate, and 7.14 g of TRITON® X-405 nonionic surfactant. The header consisted of 208.41 g of methyl methacrylate, 137.16 g of butyl acrylate, 10.69 g of potassium-3-sulfopropylmethacrylate, 373.89 ml of deionized water, 1.88 g of potassium persulfate, 9.89 g of sodium hydroxide (pellets), and 3.57 g of TRITON® X-405 surfactant. The resulting latex (1777 g, 19.32% solids) had a volume average particle diameter of about 0.10 μm (determined as for Invention Polymer 1).

Invention Polymer 5

Poly(methyl methacrylate-co-n-butyl acrylate-co-sodium 2-acrylamido-2-methyl-1-propanesulfonate) (55.59:43.42:0.99 molar ratio) 2% nonionic surfactant (based on total monomer weight)

This latex was prepared by an identical procedure as that described for Invention Polymer 1. The initial (seed) charge consisted of 9.19 g of methyl methacrylate, 9.19 g of butyl acrylate, 0.75 g of sodium 2-acrylamido-2-methyl-1-propanesulfonate, 742.89 ml of deionized water, 1.88 g of potassium persulfate, and 7.14 g of TRITON® X-405 nonionic surfactant. The header consisted of 174.56 g of methyl methacrylate, 174.56 g of butyl acrylate, 14.25 g of sodium 2-acrylamido-2-methyl-1-propanesulfonate, 371.39 ml of deionized water, 1.88 g of potassium persulfate, and 3.571 g of TRITON® X-405 nonionic surfactant. The product latex (1852.00 g, 19.11% solids) had a volume average particle diameter of about 0.16 μm (determined as for Invention Polymer 1).

Comparative Polymer 1

Poly(methyl methacrylate-co-n-butyl acrylate (56.14:43.56 molar ratio) 0.5% nonionic surfactant (based on total monomer weight)

This latex, providing an example of a latex polymer lacking covalently bound anionic groups but made with a nonionic surfactant, was prepared by a procedure that was nearly identical to that described for Invention Polymer 1. The initial (seed) charge consisted of 7.00 g of methyl methacrylate, 7.00 g of butyl acrylate, 747 ml of deionized water, 2.80 g of potassium persulfate, and 1.87 g of Olin 10G surfactant. The header consisted of 133.00 g of methyl methacrylate, 133.00 g of butyl acrylate, 373 ml of deionized water, 2.80 g of potassium persulfate, 2.80 g of n-dodecanethiol, and 0.933 g of Olin 10G surfactant. After the overnight hold, 0.35 g of each of sodium metabisulfite and potassium persulfate were added and the reaction mixture was held for an additional hour before filtration and dialysis. The product latex (1330.10 g, 20.18% solids) had a volume average particle diameter of about 0.22 μm (determined as for Invention Polymer 1).

Comparative Polymer 2

Surfactant-free latex of poly(styrene-co-sodium styrene sulfonate) (98.98:1.02 molar ratio)

This latex provides an example of a surfactant-free latex polymer containing covalently bound anionic groups. A 3-neck 1-liter round bottom flask outfitted with a mechanical stirrer, reflux condenser, and nitrogen inlet was charged with the following reagents: 98.00 g of styrene, 2.00 g of sodium styrene sulfonate, 1.00 g of potassium persulfate, and 300.00 g of deionized water. The reaction mixture was bubble degassed with nitrogen for 20 minutes and placed in a temperature-controlled water bath at 70° C. for 16 hours with stirring at 200 RPM. The product latex was poured through a cheesecloth filter. The product latex (351.52 g, 24.93% solids) had a volume average particle diameter of about 0.05 μm (determined as for Invention Polymer 1).

Comparative Polymer 3

Poly(styrene-co-N-phenyl maleimide-co-sodium styrene sulfonate) (93.41:5.96:0.63 molar ratio) latex stabilized by an anionic surfactant (5% based on total monomer weight)

This preparation provided a latex polymer containing covalently bound anionic groups and stabilized by an anionic surfactant. A 3-neck 1-liter round bottom flask outfitted with a mechanical stirrer, reflux condenser, and nitrogen inlet was charged with 3.46 g of sodium dodecyl sulfate, 0.31 g of potassium persulfate, and 192.40 g of deionized water. The flask contents were bubble degassed with nitrogen for 20 minutes and placed in a temperature-controlled water bath at 70° C. with stirring at 200 RPM. A rapidly stirred monomer suspension consisting of 93.08 g of styrene, 9.88 g of N-phenylmaleimide, 1.04 g of sodium styrene sulfonate, 103.60 g of deionized water, 0.312 g of potassium persulfate, and 1.732 g of sodium dodecyl sulfonate was added via a solvent pump over 5 hours. One hour after the addition was completed, 0.31 g of sodium metabisulfite was added. The reaction mixture was allowed to stir for an additional hour and was then poured through cheesecloth. The product latex (367.69 g, 26.58% solids) had a volume average particle diameter of about 0.02 μm (determined as for Invention Polymer 1).

Comparative Polymer 4

Poly(styrene-co-n-butyl acrylate-co-2-isopropenyl-2-oxazoline) (54.42:35.38:10.20 molar ratio) latex stabilized by a nonionic surfactant (4.5% based on total monomer weight)

This preparation provided a latex polymer stabilized by a nonionic surfactant but lacking covalently bound anionic groups. A 3-neck 1-liter round bottom flask outfitted with a mechanical stirrer, reflux condenser, and nitrogen inlet was charged with 6.00 g of Olin 10G nonionic surfactant, 1.00 g of potassium persulfate, 0.80 g of sodium carbonate, and 195.00 g of deionized water. The flask contents were bubble degassed with nitrogen for 20 minutes and placed in a temperature-controlled water bath at 40° C. with stirring at 200 RPM. A rapidly stirred monomer suspension consisting of 50.00 g of styrene, 40.00 g of butyl acrylate, 10.00 g of 2-isopropenyl-2-oxazoline, 1.00 g of potassium metabisulfite, 105.00 g of deionized water, and 3.00 g of Olin 10G surfactant was added via a solvent pump over 2 hours. The reaction mixture was stirred for an additional 2 hours and 0.50 g of each potassium metabisulfite and potassium persulfate were added. After an additional hour hold, the latex was poured through cheesecloth to separate out a moderate amount of coagulum. The product latex (458.02 g, 16.80% solids) had a volume average particle diameter of about 0.16 μm (determined as for Invention Polymer 1).

Comparative Polymer 5

Surfactant-free poly(n-butyl acrylate-co-methyl methacrylate-co-iso-propenyldimethylbenzyl isocyanate-co-sodium 2-acrylamido-2-methyl-1-propanesulfonate) (41.44:53.05:2.93:2.57 molar ratio)

This preparation provided a surfactant-free latex polymer containing covalently bound anionic groups. A 3-neck 1-liter round bottom flask outfitted with a mechanical stirrer, reflux condenser, and nitrogen inlet was charged with 1.80 g of butyl acrylate, 1.80 g of methyl methacrylate, 0.40 g of a 50% aqueous solution of sodium 2-acrylamido-2-methyl-1-propanesulfonate, 0.20 g of iso-propenyldimethylbenzyl isocyanate, 0.80 g of potassium persulfate, and 241.40 g of deionized water. The flask contents were bubble degassed with nitrogen for 20 minutes and placed in a temperature-controlled water bath at 45° C. with stirring at 200 RPM. After about 10 minutes of stirring, 0.08 g of sodium metabisulfite was added all at once. After 20 minutes, two different 90-minute reagent feeds were begun. The first feed consisted of 16.20 g of each of methyl methacrylate and butyl acrylate and 1.80 g of iso-propenyldimethylbenzyl isocyanate. The second feed consisted of 3.60 g of a 50% aqueous solution of sodium 2-acrylamido-2-methyl-1-propanesulfonate, 0.80 g of sodium metabisulfite, and 118.60 g of deionized water. After an additional 2-hour hold, the latex was poured through cheesecloth to separate out a small amount of coagulum and was dialyzed overnight using 14K cutoff dialysis tubing. The product latex (304.56 g, 11.82% solids) had a volume average particle diameter of about 0.14 μm (determined as for Invention Polymer 1).

Comparative Polymer 6

Poly(methyl methacrylate-co-n-butyl acrylate-co-sodium methacrylate) (63.54:32.67:3.79) stabilized by a nonionic surfactant (2% based on total monomer weight)

This preparation provided a latex polymer containing covalently bound carboxylate groups and stabilized by a nonionic surfactant. This latex was prepared by an identical procedure as that described for Polymer 1. The initial (seed) charge consisted of 10.97 g of methyl methacrylate, 7.22 g of butyl acrylate, 0.56 g of methacrylic acid, 747.89 ml of deionized water, 1.88 g of potassium persulfate, 7.14 g of TRITON® X-405 nonionic surfactant and 0.35 g of sodium hydroxide (pellets). The header consisted of 208.41 g of methyl methacrylate, 137.16 g of butyl acrylate, 10.69 g of methacrylic acid, 373.89 ml of deionized water, 1.88 g of potassium persulfate, 6.60 g of sodium hydroxide (pellets), and 3.57 g of TRITON® X-405 nonionic surfactant. The product latex (2683 g, 12.81% solids) had a volume average particle diameter of about 0.17 μM (determined as for Invention Polymer 1). The increased dilution of this latex was due to the accumulation of extra water during the dialysis process.

Comparative Polymer 7

Poly(styrene-co-hydroxyethyl methacrylate-co-methacrylic acid-co-ethylene glycol dimethacrylate (70.42:17.34:6.55:5.69 molar ratio) stabilized by an anionic surfactant (7.5% based on total monomer weight)

This preparation provided a latex polymer containing covalently bound carboxylic acid groups and stabilized by an anionic surfactant. This latex was prepared by the procedure described in U.S. Pat. No. 5,133,992 (Col. 11, lines 47–68 and Col. 12, lines 1–33), incorporated herein by reference. The quantities of reagents used were 39.00 g of styrene, 12.00 g of hydroxyethyl methacrylate, 3.00 g of methacrylic acid, 6.00 g of ethylene glycol dimethacrylate, 1940 g of deionized water, 0.26 g of ammonium persulfate, and 4.50 g of sodium dodecylsulfate. The latex was purified by tangential flow diafiltration using a 100K cutoff cartridge, 12 total turnovers of permeate, and a final step wherein the volume was reduced, and the latex was then concentrated. The product latex (696.40 g, 5.94% solids) had a volume average particle diameter of about 0.03 μm (determined as for Invention Polymer 1).

EXAMPLE

Preparation of Aqueous-Based Photothermographic Materials

Aqueous-based photothermographic materials of this invention were prepared in the following manner.

Preparation of Silver Benzotriazole/T-1 Co-precipitated Dispersion:

A stirred reaction vessel was charged with 900 g of lime-processed gelatin, and 6 kg of deionized water. A solution containing 216 g/kg of benzotriazole (BZT), 710 g/kg of deionized water, and 74 g/kg of sodium hydroxide was prepared (Solution A). The mixture in the reaction vessel was adjusted to a pH of 8/9 with 2.5N sodium hydroxide solution, and 0.8 g of Solution A was added to adjust the solution vAg (measured vAg—80 mV). The temperature of the reaction vessel was maintained at 50° C. The second solution containing 363 g/kg of silver nitrate and 638 g/kg of deionized water was prepared (Solution B). A third solution (Solution C) containing 3H-1,2,4-triazole-3-thione, 2,4-dihydro-4-(phenylmethyl)- (T-1, 336 g/kg), sodium hydroxide (70 g/kg), and deionized water (594 g/kg) was also prepared.

Solutions of A and B were then added to the reaction vessel by conventional controlled double-jet addition at the Solution B flow rates given in TABLE II below, while maintaining constant vAg and pH in the reaction vessel. After consumption of 97.4% total silver nitrate solution (Solution B), Solution A was replaced with Solution C and the precipitation was continued, during which Solutions B and C were added to the reaction vessel by conventional controlled double-jet addition, while maintaining constant vAg and pH in the reaction vessel.

The resulting AgBZT/AgT-1 co-precipitated emulsions were washed by conventional ultrafiltration process as described in *Research Disclosure*, Vol. 131, March 1975, Item 13122. The pH of the AgBZT/AgT-1 emulsions was adjusted to 6.0 using 2.0N sulfuric acid.

TABLE II

| | Time (min) | Solution B Flow Rate (ml/min) |
|---|---|---|
| Addition 1 | 20 | 25 |
| Addition 2 | 41 | 25–40 |
| Addition 3 | 30 | 40–80 |

Preparation of Tabular Grain Silver Halide Emulsions:

A reaction vessel equipped with a stirrer was charged with 6 liters of water containing 4.21 g of lime-processed bone gelatin, 4.63 g of sodium bromide, 37.65 mg of potassium iodide, an antifoamant, and 1.25 ml of 0.1 molar sulfuric acid. The solution was held at 39° C. for 5 minutes. Simultaneous additions were then made of 5.96 ml of 2.5378 molar silver nitrate and 5.96 ml of 2.5 molar sodium bromide over 4 seconds. Following nucleation, 0.745 ml of a 4.69% solution of sodium hypochlorite was added. The temperature was increased to 54° C. over 9 minutes. After a 5-minute hold, 100 g of oxidized methionine lime-processed bone gelatin in 1.412 liters of water containing additional antifoamant at 54° C. were then added to the reactor. The reactor temperature was held for 7 minutes, after which 106 ml of a 5 molar sodium chloride solution containing 2.103 g of sodium thiocyanate was added. The reaction was continued for 1 minute.

During the next 38 minutes, the first growth stage took place wherein solutions of 0.6 molar $AgNO_3$, 0.6 molar sodium bromide, and a 0.29 molar suspension of silver iodide (Lippmann) were added to maintain a nominal uniform iodide level of 4.2 mole %. The flow rates during this growth segment were increased from 9 to 42 ml/min (silver nitrate) and from 0.8 to 3.7 ml/min (silver iodide). The flow rates of the sodium bromide were allowed to fluctuate as needed to maintain a constant pBr. At the end of this growth segment, 78.8 ml of 3.0 molar sodium bromide were added and held for 3.6 minutes.

During the next 75 minutes the second growth stage took place wherein solutions of 3.5 molar silver nitrate and 4.0 molar sodium bromide and a 0.29 molar suspension of silver iodide (Lippmann) were added to maintain a nominal iodide level of 4.2 mole %. The flow rates during this segment were increased from 8.6 to 30 ml/min (silver nitrate) and from 4.5 to 15.6 ml/min (silver iodide). The flow rates of the sodium bromide were allowed to fluctuate as needed to maintain a constant pBr.

During the next 15.8 minutes, the third growth stage took place wherein solutions of 3.5 molar silver nitrate, 4.0 molar sodium bromide, and a 0.29 molar suspension of silver iodide (Lippmann) were added to maintain a nominal iodide level of 4.2 mole %. The flow rates during this segment were 35 ml/min (silver nitrate) and 15.6 ml/min (silver iodide). The temperature was decreased to 47.8° C. during this segment.

During the next 32.9 minutes, the fourth growth stage took place wherein solutions of 3.5 molar silver nitrate and 4.0 molar sodium bromide and a 0.29 molar suspension of silver iodide (Lippmann) were added to maintain a nominal iodide level of 4.2 mole %. The flow rates during this segment were held constant at 35 ml/min (silver nitrate) and 15.6 ml/min (silver iodide). The temperature was decreased to 35° C. during this segment.

A total of 12 moles of silver iodobromide (4.2% bulk iodide) were formed. The resulting emulsion was coagulated using 430.7 g of phthalated lime-processed bone gelatin and washed with de-ionized water. Lime-processed bone gelatin (269.3 g) was added along with a biocide and pH and pBr were adjusted to 6 and 2.5 respectively.

The resulting emulsion was examined by Scanning Electron Microscopy. Tabular grains accounted for greater than 99% of the total projected area. The mean ECD of the grains was 2.369 μm. The mean tabular thickness was 0.062 μm.

This emulsion was spectrally sensitized with 1.0 mmol of blue sensitizing dye SSD-1 per mole of silver halide. Chemical sensitization was carried out using 0.0055 mmol of sulfur sensitizer (compound SS-1a) per mole of silver halide at 60° C. for 10 minutes.

Preparation of Photothermographic Materials:

Solution $A_1$: AgBZT/AgT-1 and gelatin (35% gelatin/65% water) were placed in a beaker and heated to 50° C. for 15 minutes to melt the material. A 5% aqueous solution of 3-methylbenzothiazolium iodide was added. Mixing for 15 minutes was followed by cooling to 40° C. The sodium salt of benzotriazole was added and the mixture was stirred for 15 minutes. Mixing for 15 minutes was followed by addition of 2.5 N sulfuric acid to adjust the pH to 5.5. ZONYL FSN surfactant was then added.

Solution $B_1$: A portion of the tabular-grain silver halide emulsion prepared above was placed in a beaker and melted at 40° C.

Solution $C_1$: Solution C was prepared by adding the dry materials to water and heating to 40° C.

Solutions $A_1$, $B_1$, and $C_1$ were mixed immediately before coating to form a photothermographic emulsion formulation.

Solution $D_1$ was prepared by adding polymer, gelatin, and surfactant to water at 40° C.

Solution $D_1$ was coated simultaneously as the outer most layer above the imaging layer. A 7 mil (178 μm) transparent, blue-tinted poly(ethylene terephthalate) was used as the film support. Dry coating coverage for the imaging layer is shown in TABLE III, dry coating coverage for the protective layer is shown in TABLE IV. All of the outermost protective layers used in the practice of this invention (that is, comprising Polymers 1–5) had a surface pH (measured as described above) within the range of from 4.2 to 4.6.

TABLE III

| Solution | Component | Dry Coating Weight (mg/m$^2$) |
|---|---|---|
| $A_1$ | Silver (from AgBZT/AgT-1) | 1501 |
| $A_1$ | Lime processed gelatin | 1393 |
| $A_1$ | 3-Methylbenzothiazolium iodide | 79 |
| $A_1$ | Sodium benzotriazole | 76 |
| $A_1$ | Compound A-1 | 56 |
| $A_1$ | ZONYL FSN surfactant | 32 |
| $B_1$ | Silver (from AgBrI emulsion) | 272 |
| $B_1$ | Lime processed gelatin | 1215 |
| $C_1$ | Succinimide | 120 |
| $C_1$ | Dimethylurea | 432 |
| $C_1$ | Pentaerythritol | 544 |
| $C_1$ | 1-Ascorbyl palmitate | 4212 |

TABLE IV

| Solution | Component | Dry Coating Weight (mg/m$^2$) |
|---|---|---|
| $D_1$ | Acid processed ossein gelatin | 432 |
| $D_1$ | ZONYL FS-300 surfactant | 54 |
| $D_1$ | Negatively-charged polymer | 1728 |

Evaluation of Photothermographic Materials:

The resulting photothermographic materials were imagewise exposed for $10^{-2}$ seconds using an EG&G flash sensitometer equipped with a P-16 filter and a 0.7 neutral density filter. Following exposure, the materials were developed by heating on a heated drum for 18 seconds at 150° C. to generate continuous tone wedges. These samples provided initial Dmin, Dmax, and Relative Speed at 1.0 density above $D_{min}$ data (shown in TABLE V below).

The speeds are reported as "relative speed", determined at a density value of 1.0 about $D_{min}$. Speed values were normalized to the photographic speed (at a density of 1.0 above $D_{min}$) of a 200 mg/ft$^2$ (2.16 g/m$^2$) outermost protective layer containing only gelatin (assigned a relative speed value of 100).

Polymer stability was judged by mixing gelatin with each of the latex polymers (at a ratio of 80:20 wt. % latex:gelatin) in water and subsequently adjusting the pH of the solution to 4.5 using ascorbic acid. Stable mixtures showed little or no flocculants. Comparative Polymer examples 1–7 were not coated due to their instability with gelatin at pH 4.5, the instability was determined by the presence of significant flocculants. Polymers that were unstable with gelatin at pH 4.2–5.0, due to formation of flocculants, were not compatible when coated in an overcoat on top of the photothermographic layer described in TABLE III.

TABLE V

| Outermost Protective Layer Polymer | Polymer Stability | $D_{min}$ | $D_{max}$ | Relative Speed at 1.0 Density |
|---|---|---|---|---|
| Invention Polymer 1 | Yes | 0.32 | 2.16 | 103 |
| Invention Polymer 2 | Yes | 0.32 | 2.45 | 106 |
| Invention Polymer 3 | Yes | 0.36 | 2.80 | 108 |
| Invention Polymer 4 | Yes | 0.33 | 2.49 | 104 |
| Invention Polymer 5 | Yes | 0.32 | 2.58 | 107 |
| Gelatin only | Yes | 0.36 | 1.73 | 100 |
| Comparative Polymer 1 | No | — | — | — |
| Comparative Polymer 2 | No | — | — | — |
| Comparative Polymer 3 | No | — | — | — |
| Comparative Polymer 4 | No | — | — | — |
| Comparative Polymer 5 | No | — | — | — |
| Comparative Polymer 6 | No | — | — | — |
| Comparative Polymer 7 | No | — | — | — |

The invention has been described in detail with particular reference to certain preferred embodiments thereof, but it will be understood that variations and modifications can be effected within the spirit and scope of the invention.

What is claimed is:

1. A thermally developable imaging material comprising a support and having thereon one or more thermally developable imaging layers and an outermost protective layer over said one or more thermally developable imaging layers, said one or more thermally developable imaging layers comprising a hydrophilic binder or water-dispersible latex polymer and in reactive association:

a) a source of reducible silver ions comprising an organic silver salt, and b) an ascorbic acid or reductone reducing agent for said reducible silver ions, and said outermost protective layer having a surface pH less than 6 and comprising a negatively-charged latex polymer other than a carboxy-containing latex polymer, said negatively-charged latex polymer comprising at least 50% by dry weight of total protective layer film-forming components and from about 0.4 to about 20 mol % of recurring units derived from ethylenically unsaturated polymerizable monomers comprising sulfate, sulfonates, phosphate, or phosphonate groups, or their conjugate acids.

2. The material of claim 1 further comprising a non-ionic stabilizer associated with said negatively-charged latex polymer, said stabilizer having an HLB value of from about 7 to about 20 and present in an amount of from about 0.005 to about 0.1% based on the dry weight of said negatively-charged latex polymer.

3. The material of claim 1 wherein said source of reducible silver ions is a silver salt of an N-heterocyclic compound.

4. The material of claim 3 wherein said source of reducible silver ions is a silver salt of a compound containing an imino group, and said hydrophilic binder in said one or more thermally developable imaging layers is gelatin or a derivative thereof, a cellulosic material, or a poly(vinyl alcohol).

5. The material of claim 1 wherein said outermost protective layer has a surface pH of from about 4.0 to about 5.0.

6. The material of claim 5 wherein said outermost protective layer has a surface pH of from about 4.2 to about 4.6.

7. The material of claim 1 wherein said negatively-charged latex polymer is present in said outermost protective layer in an amount of from about 70 to about 95% based on dry weight of total protective layer film-forming components, and comprises from about 0.4 to about 15 mol % of recurring units derived from negatively-charged ethylenically unsaturated polymerizable monomers other than carboxy monomers.

8. The material of claim 1 wherein said negatively-charged latex polymer comprises recurring units derived from ethylenically unsaturated polymerizable monomers comprising sulfonates groups.

9. The material of claim 1 wherein said negatively-charged latex polymer comprises a polymer that is represented by the following Structure (II):

$$\text{(A)}_x\text{(B)}_y \qquad \text{(II)}$$

wherein A represents recurring units comprising a sulfate, sulfonates, phosphate, or phosphonate group, B represents recurring units derived from a non-charged ethylenically unsaturated polymerizable monomer, x is from about 0.4 to about 15 mol %, and y is from about 85 to about 99.6 mol %.

10. The material of claim 9 wherein A represents recurring units derived from ethylenically unsaturated polymerizable monomers having sulfonates groups and B represents recurring units derived from acrylate or methacrylate esters or styrenics.

11. The material of claim 1 wherein said negatively-charged latex polymer is present as latex particles that have an average particle size less than 2 μm, and has a glass transition temperature of from about −20 to about 50° C.

12. The material of claim 1 that is a photothermographic material that further comprises a photosensitive silver halide.

13. The material of claim 1 wherein said outermost protective layer further comprises a secondary film-forming component that is a hydrophilic colloid, second hydrophilic polymer, or a water-dispersible latex polymer that is different than and compatible with said negatively-charged latex polymer, wherein said secondary film-forming component comprises up to 50% based on the total dry weight of protective layer film-forming components.

14. A black-and-white photothermographic material comprising a support and having thereon one or more thermally developable imaging layers and an outermost protective layer over said one or more thermally developable imaging layers, said one or more thermally developable imaging layers comprising a hydrophilic binder or water-dispersible latex polymer and in reactive association:

a) a source of reducible silver ions comprising a silver salt of an N-heterocyclic compound, b) an ascorbic acid or reductone reducing agent for said reducible silver ions, and c) a photosensitive silver halide, and said outermost protective layer having a surface pH less than 6 and comprising a negatively-charged latex polymer other than a carboxy-containing latex polymer, said negatively-charged latex polymer comprising at least 50% by dry weight of total protective layer film-forming components and from about 0.4 to about 20 mol % of recurring units derived from ethylenically unsaturated polymerizable monomers comprising sulfate, sulfonates, phosphate, or phosphonate groups, or their conjugate acids, and said negatively-charged latex polymer having been prepared in the presence of a non-ionic stabilizer that becomes associated therewith, said stabilizer having an HLB value of from about 7 to about 20 and being present during latex polymer preparation in an amount of from about 0.5 to about 10% based on the dry weight of said negatively-charged latex polymer.

15. The material of claim 14 wherein said non-ionic stabilizer has an HLB value of from about 13 to about 19 and is present during preparation of said negatively-charged latex polymer in an amount of from about 0.5 to about 5% based on the dry weight of said latex polymer.

16. The material of claim 14 wherein said negatively-charged latex polymer is present as latex particles that have an average particle size of from about 0.02 to about 0.5 μm, and has a glass transition temperature of from about 10 to about 40° C.

17. The material of claim 14 wherein said source of reducible silver ions is a silver salt of a compound containing an imino group, said hydrophilic binder in said one or more imaging layers is gelatin or a derivative thereof, a cellulosic material, or a poly(vinyl alcohol), said photosensitive silver halide is present as tabular grains, and said outermost protective layer has a surface pH of from about 4.2 to about 4.6.

18. The material of claim 14 wherein said negatively-charged latex polymer is represented by the following Structure (III):

$$-(A)_x-(B)_y- \quad \text{(III)}$$

wherein A represents recurring units comprising a sulfate, sulfonates, phosphate, or phosphonate group, B represents recurring units derived from a non-charged ethylenically unsaturated polymerizable monomer, x is from about 0.4 to about 15 mol %, and y is from about 85 to about 99.6 mol %.

19. The material of claim 14 wherein said outermost protective layer further comprises a second film-forming component that is hydrophilic polymer or a water-dispersible latex polymer that is compatible with said negatively-charged latex polymer, wherein said second film-forming component comprises from about 5 to about 35% based on the dry weight of the total film-forming components in said outermost protective layer.

20. The material of claim 14 wherein said non-ionic stabilizer associated with said negatively-charged latex polymer is present in an amount of from about 0.005 to about 1% based on the dry weight of said negatively-charged latex polymer.

21. The material of claim 14 wherein said silver halide has a spectral sensitivity to a wavelength of from about 300 to about 450 nm.

22. A black-and-white photothermographic material comprising a support and having thereon one or more photothermographic layers and an outermost protective layer directly over said one or more photothermographic layers, said one or more photothermographic layers comprising predominantly gelatin or a derivative thereof, a poly (vinyl alcohol), or a water-dispersible latex polymer as the binder, and in reactive association:

a) a source of reducible silver ions comprising silver benzotriazole, b) an ascorbic acid reducing agent for said reducible silver ions, and c) photosensitive silver bromide or silver iodobromide that is present as tabular grains, and d) a mercaptotriazole toner, said outermost protective layer having a surface pH of from about 4.2 to about 4.6 and comprising a negatively-charged latex polymer other than a carboxy-containing latex polymer, said negatively-charged latex polymer comprising from about 80 to about 95% by dry weight of the total film-forming components in said protective layer, and from about 0.4 to about 10 mol % of recurring units derived from ethylenically unsaturated polymerizable monomers comprising sulfonates, or their conjugate acids, and a second film-forming component that is gelatin or a gelatin derivative.

23. The material of claim 22 wherein said negatively-charged latex polymer has been prepared in the presence of a non-ionic alkyl phenol ethoxylate stabilizer having an HLB value of from about 13 to about 19 and being present during latex polymer preparation in an amount of from about 1 to about 3% based on the dry weight of said negatively-charged latex polymer.

24. A black-and-white photothermographic material comprising a support having on a frontside thereof, a) one or more frontside imaging layers comprising a hydrophilic polymer or water-dispersible latex polymer as the binder, and in reactive association, a photosensitive silver halide, a non-photosensitive source of reducible silver ions that includes a silver salt of a compound containing an imino group, an ascorbic acid or reductone reducing agent for said non-photosensitive source reducible silver ions, and said material comprising on the backside of said support, one or more backside imaging layers comprising a hydrophilic polymer or a water-dispersible latex polymer as the binder, and in reactive association, a photo-sensitive silver halide, a non-photosensitive source of reducible silver ions that includes a silver salt of a compound containing an imino group, and an ascorbic acid or reductone reducing agent for said non-photosensitive source reducible silver ions, and wherein said one or more imaging layers on both sides of said support have the same or different composition, and b) an outermost protective layer over said one or more imaging layers on both sides of said support, each protective layer having the same or different composition, and each protective layer having a surface pH less than 6 and comprising a negatively-charged latex polymer other than a carboxy-containing latex polymer, said negatively-charged latex polymer comprising at least 50% by dry weight of total film-forming components in said protective layer, and from about 0.4 to about 20 mol % of recurring units derived from ethylenically unsaturated polymerizable monomers comprising sulfate, sulfonates, phosphate, or phosphonate groups, or their conjugate acids.

25. The material of claim 24 wherein said protective layers on each side of said support have the same composition.

26. A method of forming a visible image comprising:

A) imagewise exposing the photothermographic material of claim 14 to form a latent image, B) simultaneously or sequentially, heating said exposed photothermographic material to develop said latent image into a visible image.

27. The method of claim 26 wherein said photothermographic material comprises a transparent support, and said image-forming method further comprises:

C) positioning said exposed and photothermographic material with the visible image therein between a source of imaging radiation and an imageable material that is sensitive to said imaging radiation, and D) exposing said imageable material to said imaging radiation through the visible image in said exposed and photothermographic material to provide an image in said imageable material.

28. The method of claim 26 wherein said imagewise exposing is carried out using visible light or X-radiation.

29. The method of claim 26 wherein said photothermographic material is arranged in association with one or more phosphor intensifying screens during imaging.

30. The method of claim 26 wherein said material is imaged at a wavelength of from about 300 to about 450 nm.

31. The method of claim 26 comprising using said visible image in said exposed photothermographic material for medical diagnosis.

32. A method of forming a visible image comprising:

A) imagewise exposing the photothermographic material of claim 24 to form a latent image, B) simultaneously or sequentially, heating said exposed photothermographic material to develop said latent image into a visible image.

33. An imaging assembly comprising the photothermographic material of claim 14 that is arranged in association with one or more phosphor intensifying screens.

34. A method of forming a black-and-white image comprising exposing the imaging assembly of claim 33 to X-radiation.

* * * * *